United States Patent [19]

Langman

[11] Patent Number: 4,629,118

[45] Date of Patent: Dec. 16, 1986

[54] RAIL INSULATING PAD ASSEMBLY

[75] Inventor: William F. Langman, Lonsdale, Australia

[73] Assignee: Omark Industries, Inc., Portland, Oreg.

[21] Appl. No.: 491,930

[22] Filed: May 5, 1983

[30] Foreign Application Priority Data

May 5, 1982 [AU] Australia ..... PF3859

[51] Int. Cl.[4] ..... E01B 9/68

[52] U.S. Cl. ..... 238/107; 238/264

[58] Field of Search ..... 238/107, 264, 275, 276, 238/283, 290, 291, 154, 155

[56] References Cited

U.S. PATENT DOCUMENTS

| | | | |
|---|---|---|---|
| 996,470 | 6/1911 | Donahue | 238/275 |
| 1,016,517 | 2/1912 | Parker | 238/107 |
| 1,208,110 | 12/1916 | DeFalco | 238/291 |
| 2,867,384 | 1/1959 | Toulmin | 238/283 |
| 3,295,760 | 1/1967 | Moses | 238/283 |
| 4,216,904 | 8/1980 | Vivion | 238/283 |
| 4,239,156 | 12/1980 | Skinner | 238/283 |
| 4,489,884 | 12/1984 | Harmsen | 238/83 |

FOREIGN PATENT DOCUMENTS

| | | | |
|---|---|---|---|
| 0836268 | 6/1981 | U.S.S.R. | 238/290 |

*Primary Examiner*—Robert B. Reeves
*Assistant Examiner*—Dennis C. Rodgers
*Attorney, Agent, or Firm*—Charles F. Duffield

[57] ABSTRACT

A rail insulating pad assembly comprises two pad portions arranged to be located one over each flange of a rail foot, the pad portions, when assembled, having an abutment interface zone which contains at least one capillary path interruption aperture.

8 Claims, 7 Drawing Figures

14

FIG 1
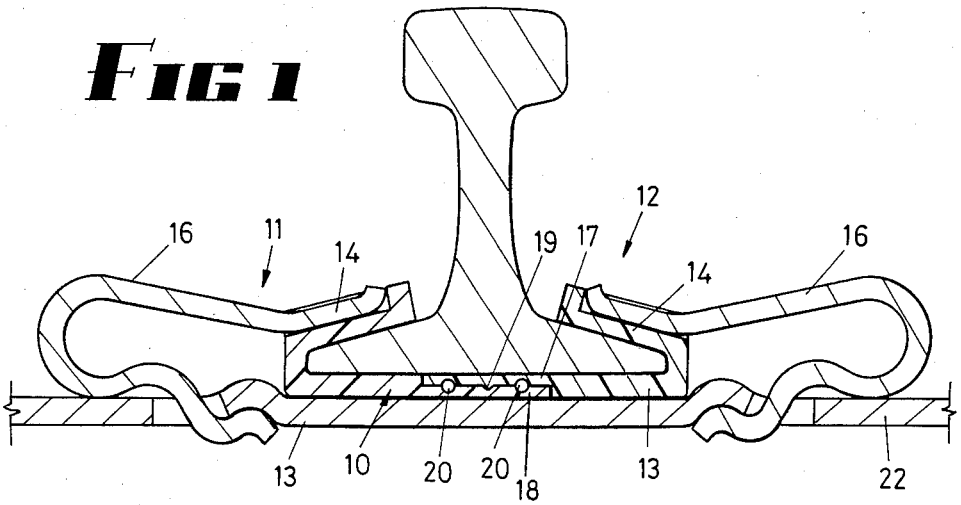
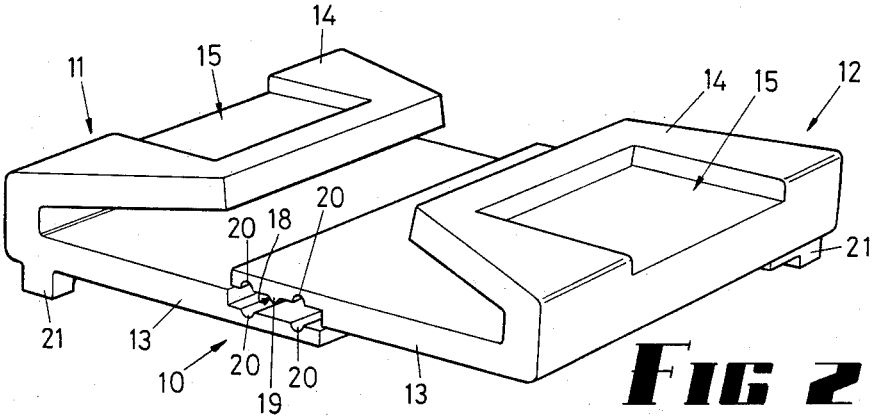
FIG 2
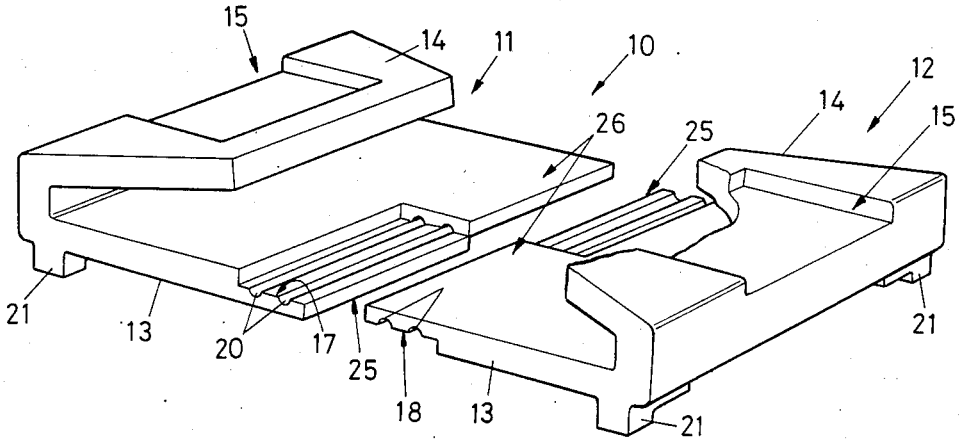
FIG 3

RAIL INSULATING PAD ASSEMBLY

This invention relates to an assembly of two portions of a rail insulating pad, useful for insulating a rail from a sleeper and also from a retaining clip.

BACKGROUND OF THE INVENTION

The rail insulating pads are in wide use on railroad tracks because of a need to use the rails as conductors for the control of electric signals. There are several problems which have been encountered heretofore however, including the difficulty of replacing a damaged or deteriorated insulator, which heretofore has usually involved lifting a rail from its sleeper by a considerable distance. Secondly, some of the previously used insulating pads have been arranged to clip over the rail foot, the pads being one-piece pads. These are effective in use but are difficult to install and replace. However, a two-piece pad has been considered undesirable heretofore because of the existence of electrical leakage problems which can develop where there are face to face abutments between portions of an assembly, since the interface zone can become wet by capillary action.

The main object of this invention is to provide an arrangement whereby a rail insulating pad can be located between a rail and a sleeper, firstly without the need of lifting the rail from the sleeper by an excessive amount and secondly, with a configuration which will interrupt capillary action so as to reduce electrical leakage.

SUMMARY OF THE INVENTION

In one aspect of this invention, a rail insulating pad assembly comprises two pad portions arranged to be located one over each flange of a rail foot, the pad portions, when assembled, having an abutment interface zone which contains at least one capillary path interruption aperture.

With this arrangement, the pads can be moved either transversely of the rail, or longitudinally in the direction of a rail, and conveniently can have stop lugs depending from them to engage the side wall of a sleeper so that the position can be accurately located before a clip is positioned. In some embodiments, there is provided a pressure rib at the interface between the pad portions which will apply such high unit pressure that formation of a capillary path is inhibited. The existence of a capillary path interruption aperture extending along the interface interrupts any capillary path which might otherwise exist, and constitutes a drain.

More specifically, a rail insulating pad assembly according to this invention comprises two pad portions, each pad portion comprising an overlie portion of configuration to overlie the top surface of a rail foot, and a flange of such shape as to form a seat for said rail foot, the flange of the respective pad portions overlapping at an abutment interface zone, at least one of the flanges containing a recess which opens into the abutment interface zone to form a capillary path interruption aperture.

BRIEF DESCRIPTION OF THE DRAWINGS

Embodiments of the invention are described hereunder in some detail with reference to, and are illustrated in, the accompanying drawings, in which FIG. 1 is a cross-section through a rail and sleeper showing a rail insulating pad assembly interposed therebetween, FIG. 2 is a perspective view of that said pad assembly, FIG. 3 is a view similar to FIG. 2, but of a second embodiment.

DESCRIPTION OF THE PREFERRED EMBODIMENTS

Figure 4:
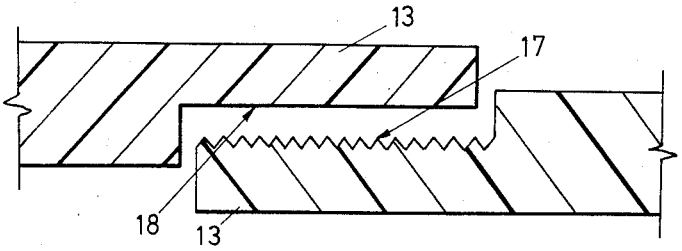
FIG. 4 is a fragmentary section showing the configuration of an abutment interface zone according to a third embodiment.

In the first embodiment of FIGS. 1 and 2, an insulating pad assembly 10 comprises a first pad portion 11 and second pad portion 12. Each pad portion 11 and 12 is provided with a flange 13 which forms a seat for the foot of the rail, and an overlie portion 14 which overlies the top surface of a rail foot. Each overlie portion 14 is provided with recess defining surfaces which define a recess 15, which said recess receives the upper leg of a plate type retaining clip.

The two flanges 13 are halved to provide an abutment interface zone between the surfaces 17 and 18, and the surface 18 has projecting downwardly from it a triangular section crushing rib 19 which is forced into contact with the surface 17 by the pressure of the rail which it supports, and thereby applies such a high unit pressure that water will not pass, thereby breaking any capillary path which may exist between the interface surfaces where they abut one another. To further assist in breaking such a capillary path, there are provided grooves 20 in each of the surfaces 17 and 18, the grooves 20 aligning to make circular section openings extending for the length of the surfaces 17 and 18, and these also assist in providing a capillary path break.

For initial assembly, each of the portions 11 and 12 is simply moved laterally on to its rail foot part, and slide longitudinally along the rail foot until the stop lugs 21 engage the side wall of the sleeper 22, at which stage the recesses 15 will be aligned with the openings in the sleeper for reception of their respective retaining clips. The retaining clips are then simply driven into position to urge downwardly on the foot of the rail, but through the overlie portions 14. The amount of lift required to be applied to a rail is very small indeed to allow this action to take place. The pad portions are inexpensive mouldings, and the resultant pad overlaps the sleeper, and in any case embodies means to inhibit the formation of capillary paths wherein moisture can otherwise cause a leakage path for electrical current. The surfaces which define the recesses 15 prevent displacement of the pad portions once the portions are engaged by their respective clips.

In the second embodiment of FIG. 3, the pad assembly is very similar to that of the first embodiment of FIG. 2 and similar elements are indicated by similar designations. However each flange 13 is divided longitudinally into a lower portion 25 and an upper portion 26 which will overlie the lower portion 25 of the other pad, and the pads are symmetrical about a central transverse plane. This means that each pad portion is identical to the other and thereby effects a saving in the cost of tooling and inventory.

In the first embodiment there were two only lugs 21 and these enable the pad portions 11 and 12 to slide longitudinally. While this feature can also be included in the second embodiment, there may also be provided further lugs 21, there being two on each pad portion, these being arranged to straddle a sleeper and engage its side walls since the pad portions 11 and 12 of the second embodiment can be moved towards one another along the sleeper transverse to the rail.

The embodiment of FIG. 4 illustrates an alternative configuration wherein the under surface 18 of the upper flange 13 is plain whereas the upper surface 17 of the lower flange 13 is serrated. The serrations cause the formation of a plurality of grooves and also a plurality of high pressure areas effective in interrupting any capillary path which might otherwise cause electrical leakage.

Figure 5:
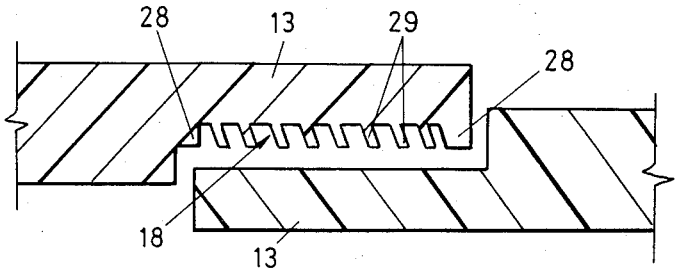
FIG. 5 is a fragmentary section showing the configuration of an abutment interface zone according to a fourth embodiment.

In the fourth embodiment of FIG. 5, a similar effect is achieved, in that the lower surface 18 of the upper flange 13 has a pair of beads 28 extending along it which, in use, will tend to crush, and between the beads 28 there are located sloping leaves 29 which will deflect as the two flanges 13 come together, these providing a plurality of spaced apertures which interrupt any capillary path.

Figure 6:
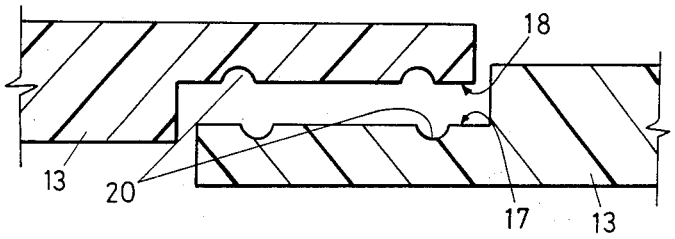
FIG. 6 is a fragmentary section showing the configuration of an abutment interface zone according to a fifth embodiment.

The fifth embodiment of FIG. 6 shows a configuration similar to that of FIG. 3 and again similar elements bear similar designations. However in the configuration of FIG. 6 the lower flange 13 has a constant cross-sectional shape as does the upper flange 13 so that the apertures formed by the grooves 20 extend from end to end without any interruption to their walls intermediate their ends as in FIG. 3.

Figure 7:
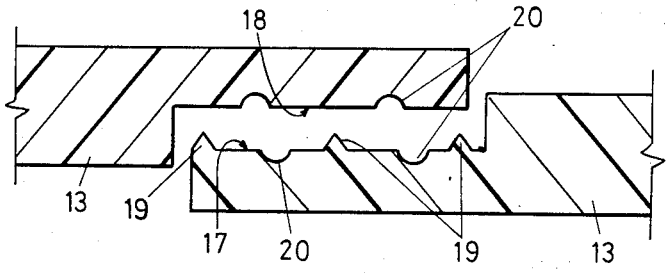
FIG. 7 is a framentary section showing the configuration of an abutment interface zone according to a sixth embodiment.

The sixth embodiment of FIG. 7 is generally similar to the first embodiment of FIGS. 1 and 2, but there are provided three triangular ribs 19 spaced from one another which flank the apertures formed by the grooves 20.

What is claimed is:

1. A two-piece rail insulating pad assembly for use in between the foot of a railroad rail and a rail sleeper extending transversely to the rail and preventing capillary mositure action comprising two insulating pad portions, each pad portion being a molding comprising an overlie portion of configuration to overlie the top surface of the rail foot, and a flange of length approximating the width of the sleeper and of such shape as to form a seat for said rail foot, the flanges of the respective pad portions so overlapping one another as to form an abutment interface zone between them, at least one of the flanges having at least one groove which opens into, and extends for the entire length of, the abutment interface zone to form a capillary path interruption aperture.

2. A rail insulating pad assembly according to claim 1 wherein at least one of said flanges has a projecting rib extending along its length parallel to, and located between, a pair of said grooves, the shape of said rib being such that it is capable of being crushed by rail pressure in use to exert a high unit pressure upon the opposing flange to inhibit capillary action.

3. A rail insulating pad assembly according to claim 1 wherein one of said flanges has a serrated surface which bears against a plane surface of the other of said flanges at the locality of said abutment interface zone to form a plurality of spaced said grooves each forming a separate said capillary path interruption aperture.

4. A rail insulating pad assembly according to claim 1 wherein one of said flanges has a plurality of inclined leaves projecting therefrom which abut a plane surface of the other said flange at the abutment interface zone to thereby form a plurality of said capillary path interruption apertures.

5. A rail insulating pad assembly according to claim 1 wherein each said overlie portion has surfaces defining respective rail clip receiving recesses.

6. A rail insulating pad assembly according to claim 1 wherein each said pad portion has at least one sleeper lug depending from one end thereof, and being of such shape and location that it will bear against a shoulder of a sleeper when that said pad portion is supported by that said sleeper.

7. A rail insulating pad assembly according to claim 6 wherein each said pad portion has a pair of depending sleeper lugs which depend from opposite ends thereof and which bear against a shoulder of a sleeper when that said portion is supported by that said sleeper.

8. In combination, a railroad sleeper and a rail insulating pad assembly according to any one of the preceding claims wherein the insulating pad assembly is longer than the width of the sleeper and wherein the ends of said pad assembly overlap said sleeper.

* * * * *